US008360811B2

(12) United States Patent
Aoki

(10) Patent No.: US 8,360,811 B2
(45) Date of Patent: Jan. 29, 2013

(54) FIXING STRUCTURE FOR FIXING METAL PLATE AND BOLT TO SYNTHETIC RESIN MEMBER

(75) Inventor: Eiji Aoki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/259,741

(22) PCT Filed: Jun. 17, 2010

(86) PCT No.: PCT/JP2010/060696

§ 371 (c)(1),
(2), (4) Date: Sep. 23, 2011

(87) PCT Pub. No.: WO2011/010523

PCT Pub. Date: Jan. 27, 2011

(65) Prior Publication Data

US 2012/0028509 A1 Feb. 2, 2012

(30) Foreign Application Priority Data

Jul. 24, 2009 (JP) ..... 2009-172714

(51) Int. Cl.
*H01R 4/30* (2006.01)

(52) U.S. Cl. ..... 439/801; 439/736

(58) Field of Classification Search ..... 439/736, 439/801

See application file for complete search history.

(56) References Cited

U.S. PATENT DOCUMENTS 3,761,867 A * 9/1973 Churla ..... 439/413
5,487,685 A * 1/1996 Stillback et al. ..... 439/801
5,759,055 A * 6/1998 Colantuano et al. ..... 439/287
6,206,737 B1 3/2001 Bonilla et al.
6,294,978 B1 9/2001 Endo et al.
6,450,842 B1 * 9/2002 Matsuda et al. ..... 439/801
6,527,598 B1 3/2003 Opel (Continued)

FOREIGN PATENT DOCUMENTS

JP 2000164111 A 6/2000
JP 2004047471 A 2/2004

(Continued)

OTHER PUBLICATIONS

International Search Report and Written Opinion of International Application Serial No. PCT/JP2010/060696 dated Aug. 17, 2010.

(Continued)

*Primary Examiner* — James Harvey
(74) *Attorney, Agent, or Firm* — Edwards Wildman Palmer LLP

(57) ABSTRACT

A downsized fixing structure for fixing a metal plate and a bolt to a synthetic resin member which can prevent an upper surface of the metal plate from being covered by a resin, is provided. The fixing structure includes: a bus bar, i.e. the metal plate; the bolt having the head portion and the shank portion passed through a through hole provided at the bus bar; and a housing 9, i.e. the synthetic resin member, to which the bus bar and the bolt are fixed. Fixing portions projecting from a surface of the head portion of the bolt adjacent to the shank portion of the bolt are arranged to penetrate into the metal plate to be fixed thereto. A circumferential surface of the head portion of the bolt is knurled. The head portion is formed together with the housing by insert molding.

8 Claims, 8 Drawing Sheets

U.S. PATENT DOCUMENTS

| | | | | |
|---|---|---|---|---|
| 7,052,332 | B2 * | 5/2006 | Heller et al. | 439/766 |
| 7,435,134 | B2 * | 10/2008 | Lenox | 439/567 |
| 7,597,516 | B2 * | 10/2009 | Bucciferro et al. | 411/187 |
| D631,736 | S * | 2/2011 | You | D8/387 |
| 2004/0005823 | A1 * | 1/2004 | An | 439/801 |
| 2006/0257229 | A1 | 11/2006 | Bucciferro et al. | |
| 2009/0003960 | A1 * | 1/2009 | Lin | 411/161 |
| 2011/0039430 | A1 * | 2/2011 | Aftanas | 439/92 |
| 2011/0274514 | A1 * | 11/2011 | Lee | 411/368 |
| 2012/0028509 | A1 * | 2/2012 | Aoki | 439/736 |

FOREIGN PATENT DOCUMENTS

| | | | |
|---|---|---|---|
| JP | 2006228682 | A | 8/2006 |

OTHER PUBLICATIONS

Supplementary European Search Report dated Oct. 31, 2012, issued for the European Patent Application No. 10802144.5.

* cited by examiner

FIXING STRUCTURE FOR FIXING METAL PLATE AND BOLT TO SYNTHETIC RESIN MEMBER

CROSS REFERENCE TO RELATED APPLICATIONS

This application is a U.S. National Stage application pursuant to 35 U.S.C. §371 of International Application No. PCT/JP2010/060696, filed Jun. 17, 2010, which claims the benefit of priority of Japanese Patent Application No. 2009-172714, filed Jul. 24, 2009, the disclosures of each of which are expressly incorporated herein by reference in their entireties.

BACKGROUND OF THE INVENTION

1. Field of the Invention

The present invention relates to a fixing structure for fixing, for example, a metal plate to be electrically connected to a wiring member such as a round terminal, and a bolt fixing the wiring member and the metal plate together, to a synthetic resin member. The present invention further relates to a connector having the above-described fixing structure.

2. Description of the Related Art

Various electric components in which a wiring member, such as a round terminal, and a metal plate, such as a bus bar, are fixed to each other by a bolt and a nut for an electrical connection, are known. One of such electric components disclosed for example in Japanese Patent Application Publication No. 2000-164111, shown in FIG. 8, includes a metal plate and a bolt, both of which are pre-fixed to a synthetic resin member such as a housing to facilitate assembly.

FIG. 8 is a cross-sectional view of the conventional fixing structure for fixing a metal plate and a bolt to a synthetic resin member. For a fixing structure 206 shown in FIG. 8 for fixing a metal plate and a bolt to a synthetic resin member, both edges 252, 253 of a metal plate 205 and a head portion 203 of a bolt 201 formed together with a synthetic resin member 207 by insert molding.

In addition, the bolt 201 has a shank portion 202 passing through a through hole 251 of the metal plate 205. In such manner, the metal plate 205 and the bolt 201 are fixed to the synthetic resin member 207. When insert molding the metal plate 205 and the bolt 201 with the synthetic resin 207, first the metal plate 205 and the bolt 201 are inserted inside a die, the die for producing the synthetic resin member 207, and are positioned at a predetermined position in the die. Then, molten synthetic resin is poured into the die to form the metal plate 205 and the bolt 201 together with the synthetic resin 207.

The metal plate 205 and an LA terminal 211 which is a round terminal disposed on an upper surface 250 of the metal plate exposed on outside of the synthetic resin member 207, are sandwiched between the bolt 201 and a nut 213 to be electrically connected to each other.

However, the above-described fixing structure 206 for fixing the metal plate and the bolt to the synthetic resin has a problem. That is, since the both edges 252, 253 of the metal plate 205 are buried under burying portions 270 (circled portions shown in FIG. 8) of the synthetic resin member 207, with the burying portions 270 covering the upper surface 250 of the metal plate 205. Thus, the upper surface 250 is often covered by a resin (in other words, resin is attached to the upper surface). Such resin attachment to the upper surface of the metal plate is undesirable because it can cause a lowering in a connection reliability between the metal plate 205 and the LA terminal 211.

Furthermore, for the above-described fixing structure 206, since the both edges 252, 253 of the metal plate 205 are formed together with the synthetic resin member 207 by insert molding in order to be fixed to the synthetic resin member 207, the metal plate 205 needs to be larger than a dimension required to locate the LA terminal thereon. Such an increase in size of the metal plate 205 eventually leads to an increase in size of the electric components having the fixing structure 206.

SUMMARY OF THE INVENTION

Solution to Problem

In view of the above-described problems, an object of the invention is to provide a downsized fixing structure for fixing a metal plate and a bolt to a synthetic resin member which can prevent an upper surface of the metal plate from being covered by a resin. Another object of the invention is to provide a connector having the above-described fixing structure.

In order to achieve the above-described object, a fixing structure for fixing a metal plate and a bolt to a synthetic resin member according to the present invention includes a fixing portion provided at a surface of a head portion of the bolt, the surface being adjacent to a shank portion of the bolt, the shank portion passing through a through hole of the metal plate, the fixing portion projecting from the surface of the head portion of the bolt so as to penetrate into the metal plate to be fixed to the metal plate, and the head portion of the bolt being insert molded with the synthetic resin member.

Furthermore, a fixing structure for fixing a metal plate and a bolt to a synthetic resin member according to the present invention is the fixing structure described above, where more than one fixing portions are provided, each of the fixing portions being formed into a rib extending from an outer edge of the head portion towards a center of the head portion, and the fixing portions are provided with a space between each other.

Furthermore, a fixing structure for fixing a metal plate and a bolt to a synthetic resin member according to the present invention, is any one of the above-described fixing structures, where a circumferential surface of the head portion of the bolt is knurled.

Furthermore, in order to achieve the above-described object, a connector according to the present invention includes a metal plate to be electrically connected to a wiring member, a bolt fixing the wiring member and the metal plate together, and a synthetic resin member to which the metal plate and the bolt are mounted, where the metal plate and the bolt are fixed to the synthetic resin member by any one of the above-described fixing structure.

Advantageous Effects of the Invention

According to the above-described invention, the fixing portion projects from the surface of the head portion adjacent to the shank portion so as to penetrate into the metal plate to be fixed thereto, and the head portion of the bolt is insert molded with the synthetic resin member. Therefore, the metal plate can be fixed to the synthetic resin member via the bolt without insert molding both edges of the metal plate with the synthetic resin member. In addition, the width of the metal plate can be reduced as compared to insert molding both edges of the metal plate with the synthetic resin member. Consequently, a downsized fixing structure for fixing a metal plate and a bolt to a synthetic resin which can prevent the upper surface of the metal plate from being covered by resin can be provided. Furthermore, since the metal plate is fixed to the head portion by the fixing portion prior to insert molding the head portion with the synthetic resin member, the metal plate and the bolt can be easily positioned at a predetermined position in the die by positioning the metal plate. Therefore, a preparation of the die for insert molding can be facilitated.

Furthermore according to the above-described invention, the plurality of the fixing portions are provided with a space and are formed into the rib extending from the outer edge of the head portion towards the center thereof. Thus, the metal plate can be securely fixed by the fixing portions.

Furthermore, according to the above-described invention, the circumferential surface of the head portion of the bolt is knurled, increasing the friction force between the circumferential surface of the head portion and the synthetic resin member. Consequently, when a nut is threadably mounted to the bolt, a torque applied thereto can be prevented from transmitting to the metal plate. The knurled surface can also prevent the bolt from idling or separating from the synthetic resin member.

Furthermore, according to the above-described invention, since the connector is provided with any one of the above-described fixing structure for fixing the metal plate and the bolt to the synthetic resin member, the down sized connector with high connection reliability between the wiring member and the metal plate can be provided.

DETAILED DESCRIPTION OF THE INVENTION

Figure 1:
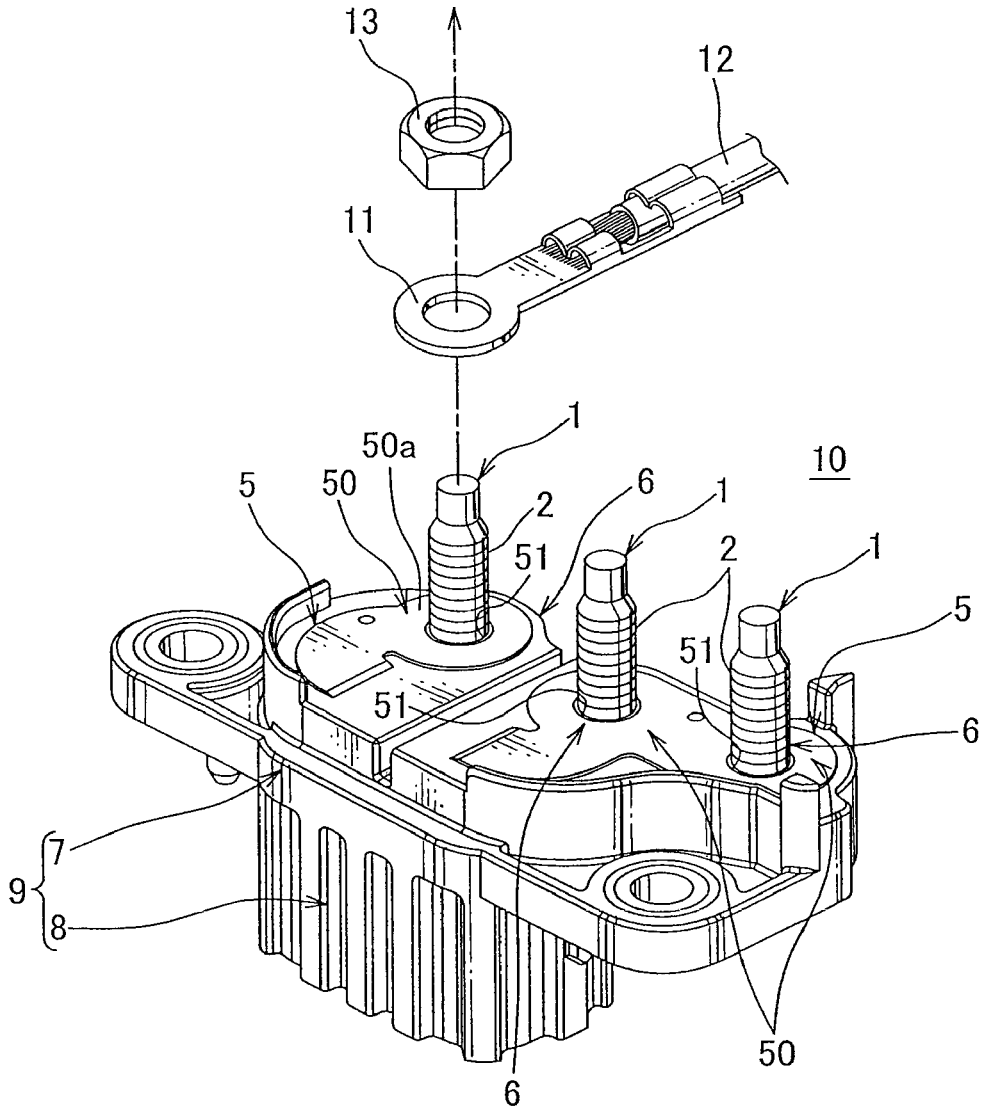
FIG. 1 is a perspective view of a connector having a fixing structure, for fixing a metal plate and a bolt to a synthetic resin member, of the present invention according to one embodiment.

In the following, an embodiment of "a fixing structure for fixing a metal plate and a bolt to a synthetic resin member" according to the present invention as well as a connector having the above-described fixing structure will be described with reference to FIG. 1 through FIG. 7

"A fixing structure for fixing a metal plate and a bolt to a synthetic resin member" according to the present invention is a fixing structure which fixes a metal plate and a bolt to a synthetic resin member, the bolt having a head portion and a shank portion passing through a through hole of the metal plate. In the following, "a fixing structure for fixing a metal plate and a bolt to a synthetic resin member" of the present invention applied to a connector will be explained.

A connector 10, shown in FIG. 1 through FIG. 3, includes: bus bars 5 provided in a pair to be electrically connected, respectively, with an LA terminal 11 attached to an end of an electric wire 12; a plurality of bolts 1 each fixing the LA terminal 11 and the bus bar 5 together; a housing 9 to which the pair of bus bars 5 and the plurality of bolts 1 are attached; and "a fixing structure for fixing a metal plate and a bolt to a synthetic resin member 6 (hereinafter called the fixing structure 6)". The bus bar 5, the LA terminal 11 and the housing 9 correspond respectively to "a metal plate", "a wiring member" and "a synthetic resin member", respectively.

The pair of bus bars 5 are formed for example by press processing thin metal plates. Each of the bus bars 5 includes a connection portion 50 to which the LA terminal 11 is electrically connected (refer to FIG. 1 and FIG. 3) and a terminal portion 52 to which a connector not shown is electrically connected (refer to FIG. 2). Both of the connection portion 50 and the terminal portion 52 are formed in one. The connection portion 50 is arranged at an upper surface of the housing 9 and is formed into a ring-like shape having a through hole 51 through which a shank portion 2 of the bolt 1 is passed. The terminal portion 52 is bent so as a band-like portion thereof extends perpendicularly from a lower surface of the housing 9, the band-like portion continuous with the connection portion 50.

In the description, for the terms "the upper surface of the housing 9" and "the lower surface of the housing 9", "upper" and "lower" may not correspond to the actual direction. That is, in the present invention "the upper surface of the housing 9" may be located below "the lower surface of the housing 9".

Figure 4:
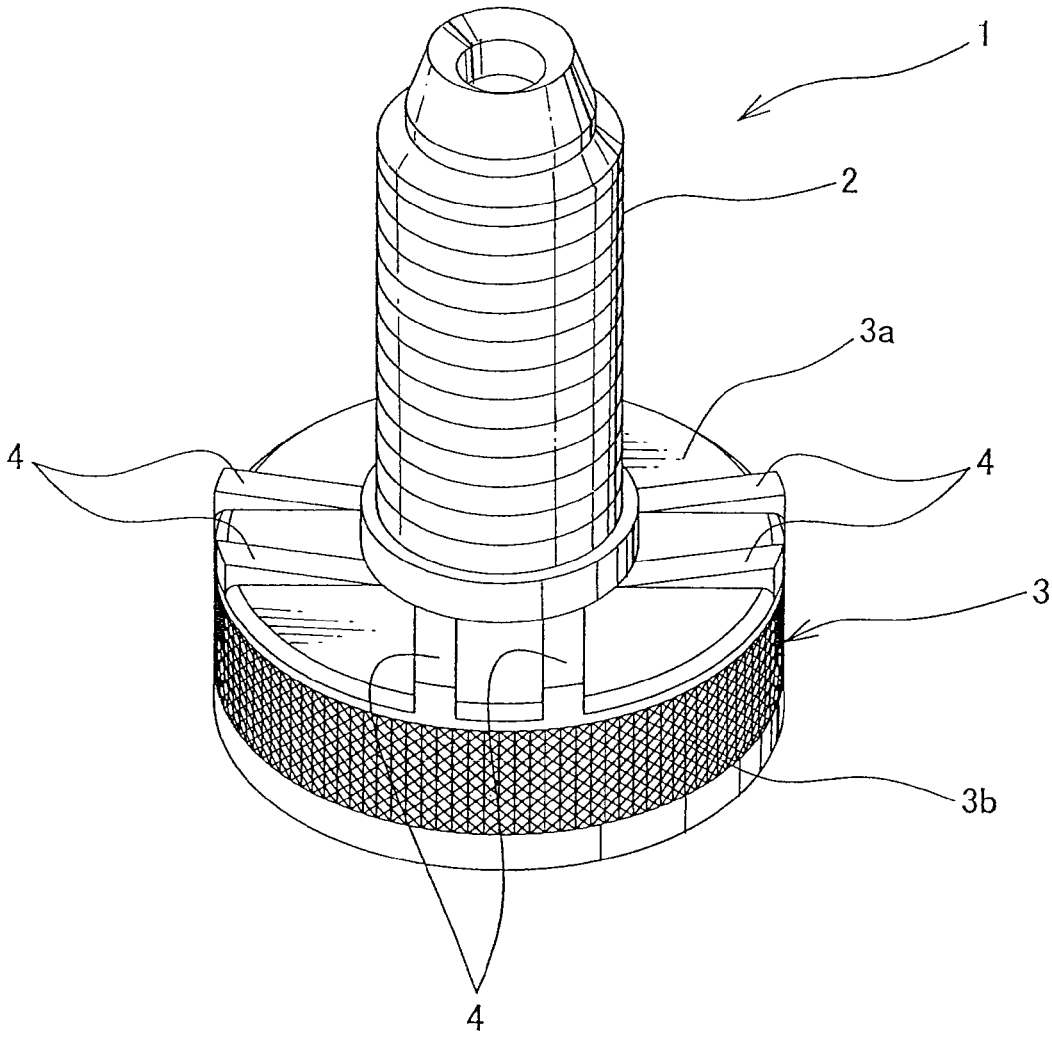
FIG. 4 is a perspective view of a bolt of the fixing structure shown in FIG. 1.

The bolt 1 is made of metal and includes: the cylindrical shank portion 2 with thread grooves formed on a surface thereof; and a disk-like shaped head portion 3 provided at one end of the shank portion 2, as shown in FIG. 4. The shank portion 2 and the head portion 3 are formed in one. The shank portion 2 of the bolt 1 is passed through the through hole 51 of the connection portion 50. The respective bolts 1 extend perpendicularly from the upper surface of the housing 9.

The housing 9 is made of a synthetic resin and includes: a body portion 7 to which the pair of bus bars 5 and the plurality of bolts 1 are attached; and a tubular portion 8 surrounding the respective terminal portions 52 of the pair of bus bars 5. The body portion 7 and the tubular portion 8 are formed in one.

Next, the fixing structure 6 of the present invention will be explained in detail. As shown in FIG. 3, the fixing structure 6 includes the bus bars 5, the head portion 3 of the bolt 1 and the body portion 7 of the housing 9.

A plurality of fixing portions 4 projects from a surface 3*a* of the head portion 3 of the bolt 1, the surface being adjacent to the shank portion 2. The fixing portions 4 are arranged to penetrate into the connection portion 50 to be fixed thereto. Each of the fixing portions 4 is formed into a rib extending from an outer edge of the head portion 3 towards a center of the head portion 3. The fixing portions 4 are arranged with a space between each other. A circumferential surface 3*b* of the head portion 3 is knurled to prevent the bolt 1 from rotating. The bus bar 5 fixed to the head portion 3 via the fixing portions 4 of the head portion 3 and the head portion 3 are insert molded with the body portion 7 and are fixed to the body portion 7.

Figure 5:
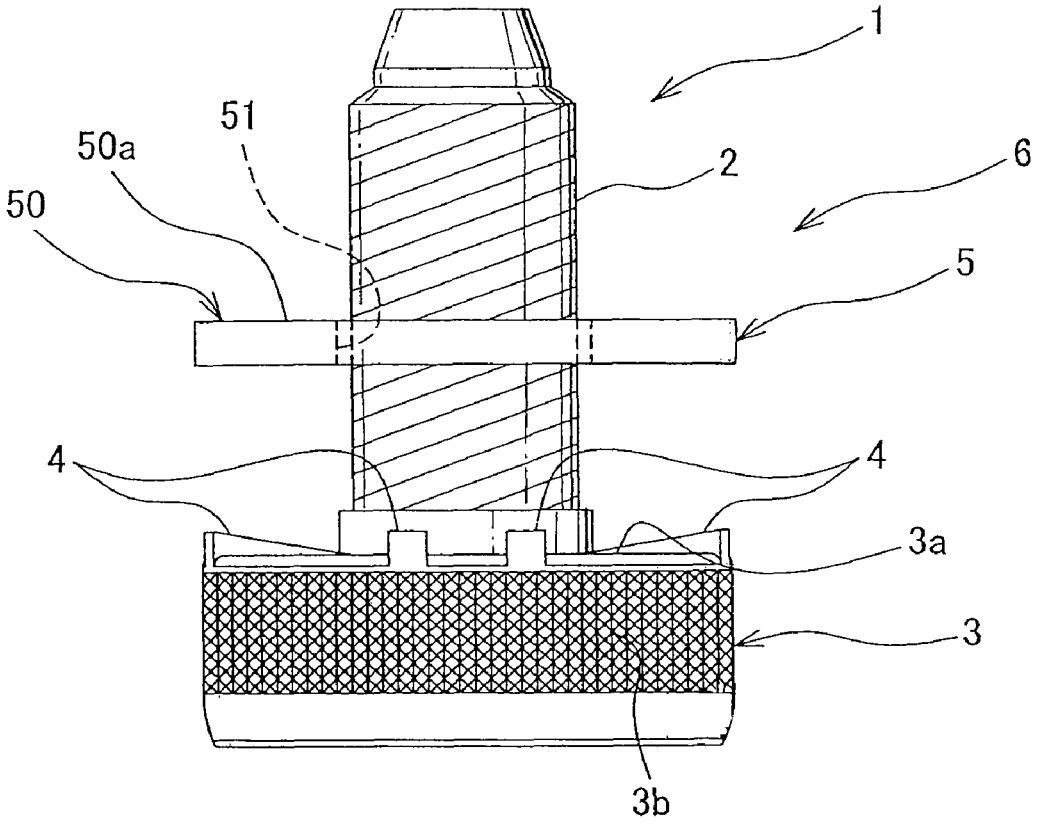
FIG. 5 is an explanatory illustration explaining an assembling procedure of the fixing structure shown in FIG. 1.
Figure 6:
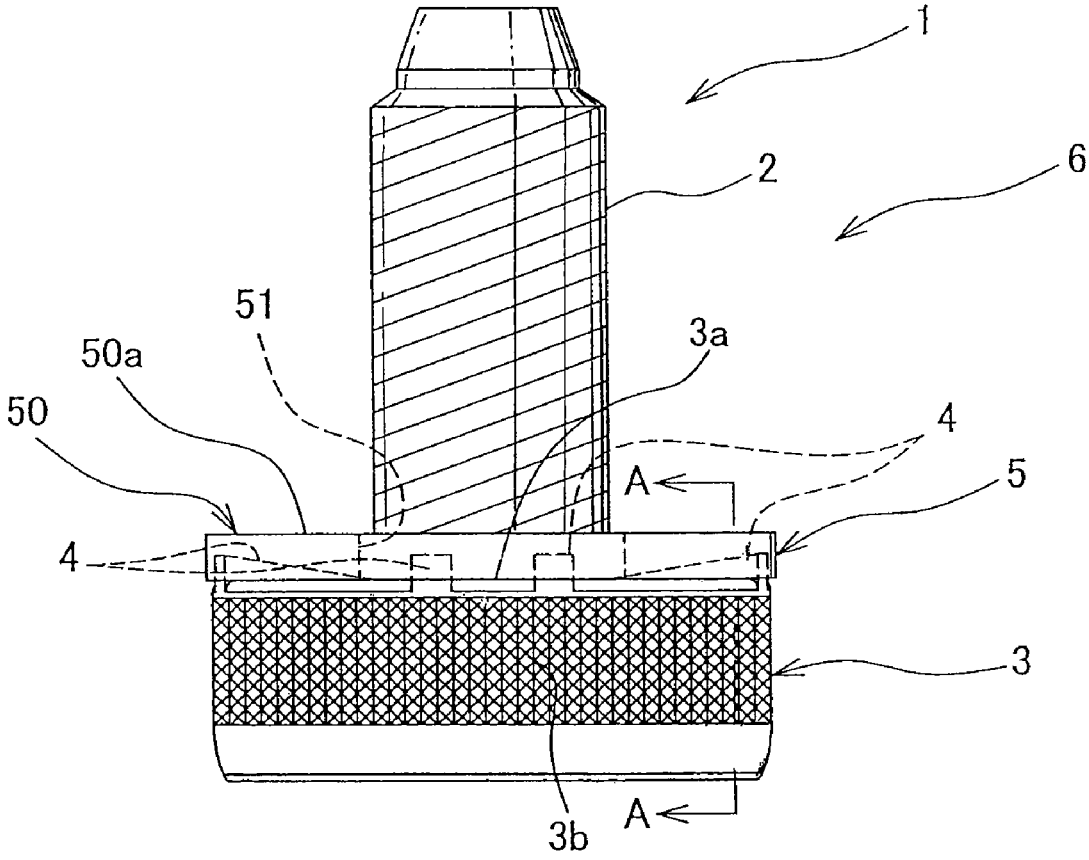
FIG. 6 is a plan view of the bolt and the metal plate shown in FIG. 5, the bolt and the metal plate are fixed together via the fixing portions of the bolt.
Figure 7:
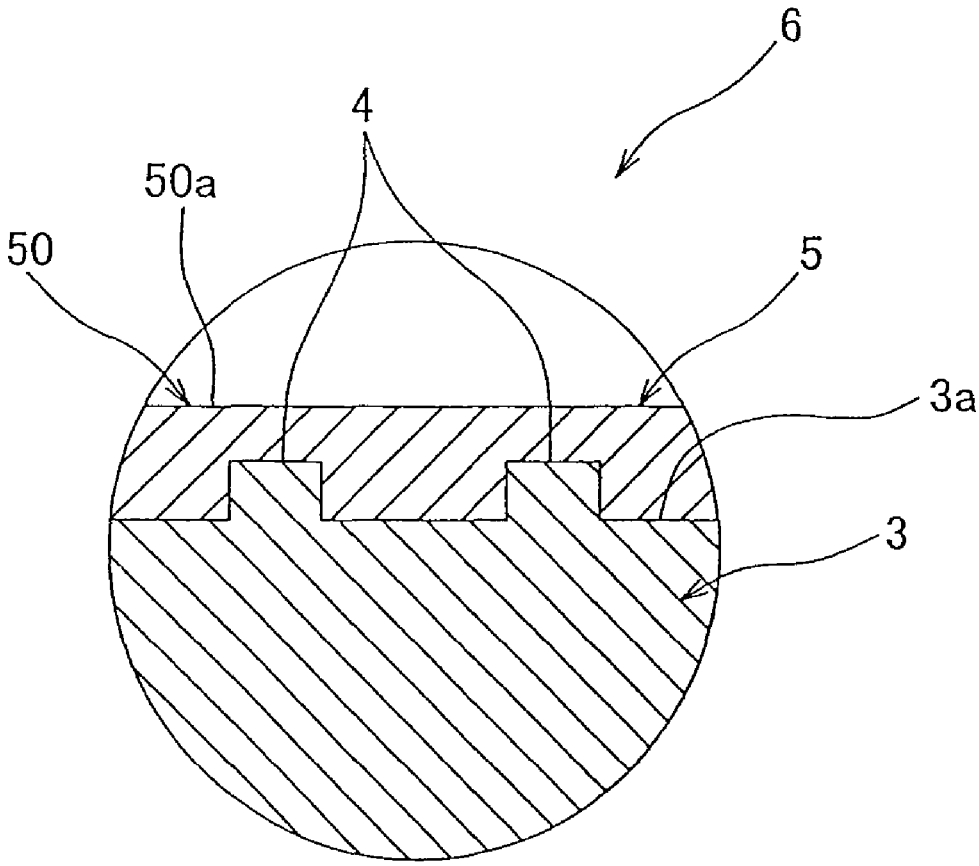
FIG. 7 is a cross-sectional view taken along the line A-A indicated in FIG. 6.
Figure 8:
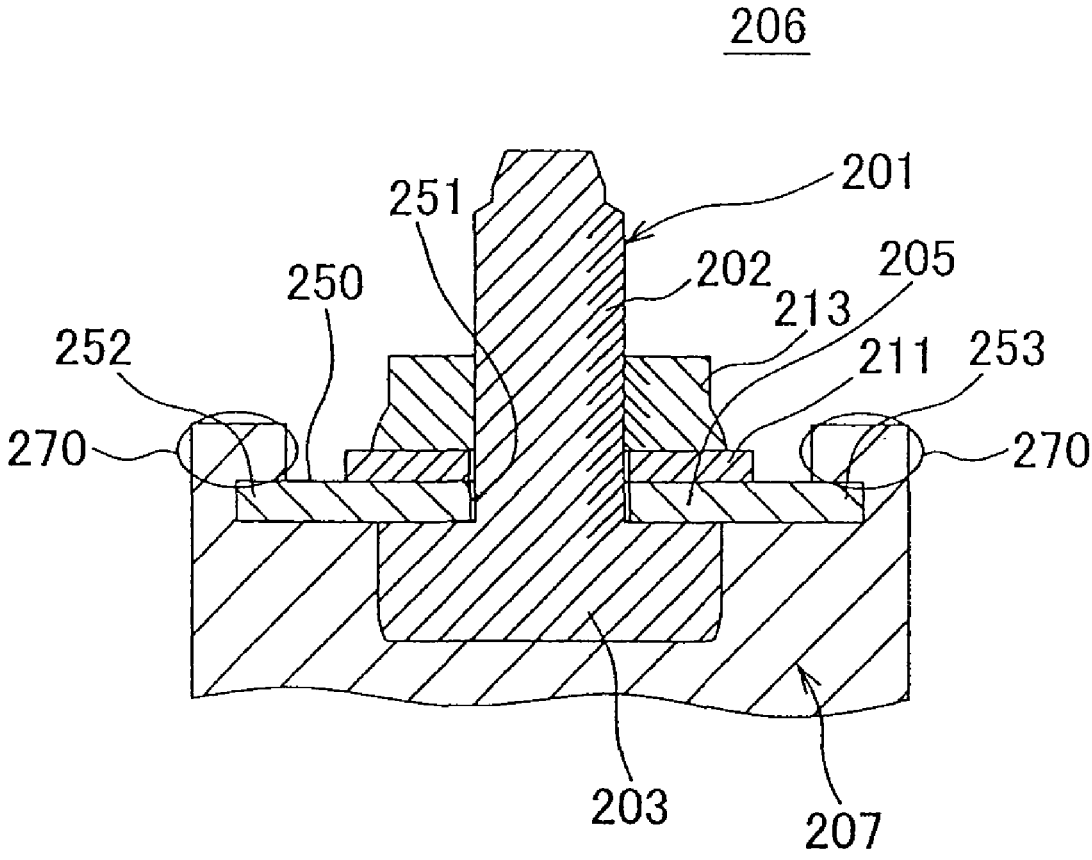
FIG. 8 PRIOR ART
FIG. 8 is a cross-sectional view of a conventional fixing structure for fixing a metal plate and a bolt to a synthetic resin member.

Next, a procedure for insert molding the head portion 3 of the bolt 1 and the bus bar 5 with the body portion 7, i.e. with the housing 9, will be explained. First, as shown in FIG. 5, the shank portion 2 of the bolt 1 is passed through the through hole 51 of the bus bar 5. Then, as shown in FIG. 6, a pressure is applied to the bus bar 5 and the head portion 3 of the bolt 1 so that the bus bar 5 and the head portion 3 move towards each other. Then, the plurality of fixing portions 4 are forced to penetrate into the connection portion 50 of the bus bar 5. In this manner, the plurality of fixing portions 4 can fix the connection portion 50, i.e. the bus bar 5, to the surface 3*a* of the head portion 3 of the bolt 1.

Then, the bolt 1 and the bus bar 5 fixed to each other are inserted into a die used to produce the housing 9, and the bus bar 5 is positioned at a predetermined position. By positioning the bus bar 5 at the predetermined position, the bolt 1 can also be positioned at the predetermined position. After such preparation for the die is done, molten synthetic resin is poured into the die and cured. In such manner, the head portion 3 and the bus bar 5 are formed together with the housing 9 by insert molding.

Figure 3:
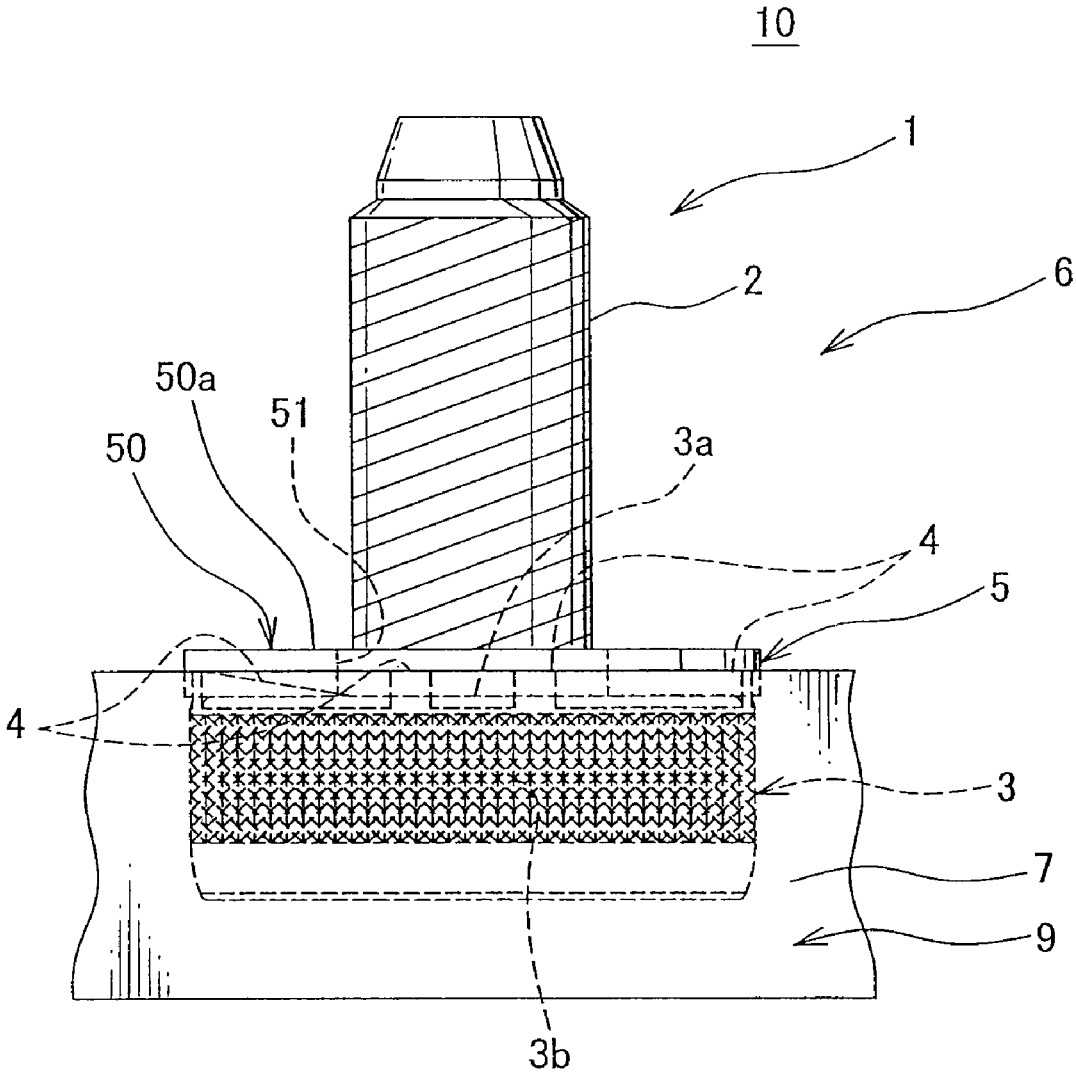
FIG. 3 is a plan view of the connector shown in FIG. 1.

For the connector 10 produced according to the above-described manner, a whole portion of the head portion 3, a half portion of the connection portion 50 adjacent to the head portion 3 in a thickness direction, and an end portion of the terminal portion 52 adjacent to the connection portion 50, are buried in the body portion 7, as shown in FIG. 3. A whole surface of an upper surface 50*a* of the connection portion 50 distant from the head portion 3 is exposed on the outside of the body portion 7.

Figure 2:
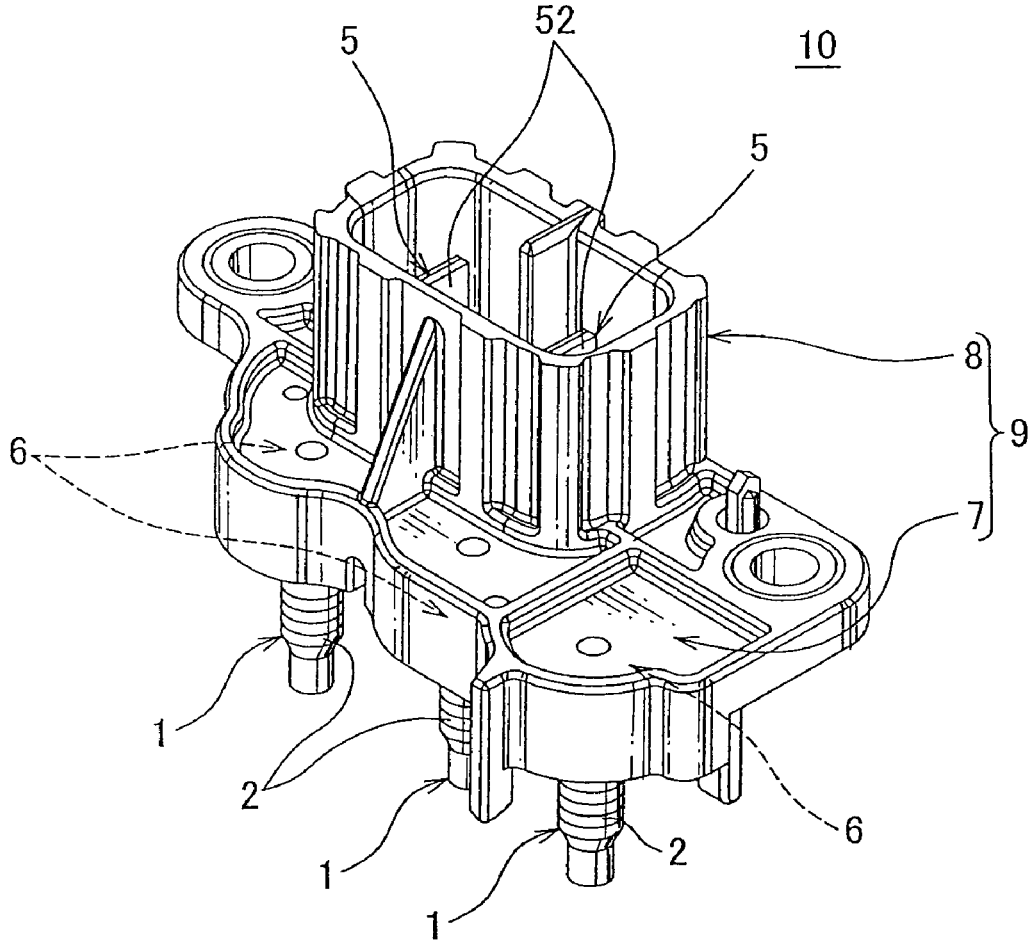
FIG. 2 is a perspective view of the connector shown in FIG. 1.

For the above-described connector 10, the shank portion 2 of the bolt 1 is passed through an opening of the LA terminal 11, and a nut 13 is threadably mounted to the shank portion 2, as shown in FIG. 1. In such manner, the connection portion 50 and the LA terminal 11 can be electrically connected to each other. Furthermore, by inserting the connector not shown into the tubular portion 8 thereby mating a terminal of the connector not shown to the terminal portion 52, the terminal of the connector not shown and the terminal portion 52 can be electrically connected to each other. In such manner, the connector 10 electrically can connect the electrical wire 12 and the connector not shown via the bus bar 5.

According to the present invention, as described above, the connection portion 50 of the bus bar 5 is fixed to the head portion 3 of the bolt 1 via the fixing portions 4. Consequently, the connection portion 50 can be securely fixed to the body portion 7 without burying the both edges of the connection portion 50 in the body portion 7. Furthermore, for the connector 10 according to the invention, the whole surface of the upper surface 50*a* of the connection portion 50 is positioned above the upper surface of the body portion 7, that is, the whole surface of the upper surface 50*a* of the connection portion 50 is exposed on the outside of the body portion 7. Consequently, the upper surface 50*a* of the connection portion 50 can be prevented from being covered by a resin, improving a connection reliability between the LA terminal 11 and the connection portion 50, i.e. the bus bar 5.

Furthermore, according to the present invention, since the both edges of the connection portion 50 are not buried in the body portion 7 and the whole surface of the upper surface 50*a* is exposed on the outside of the body portion 7, the width of the connection portion 50 can be provided with a minimum width required to place the LA terminal thereon in an overlapping relationship. Consequently, the width of the connection portion 50, or the bus bar 5, can be reduced as compared to a case in which the both edges of the connection portion 50 are buried in the body portion 7. As a result, an amount of metal used for the bus bars 5 and an amount of resin used for the housing 9 can be reduced, downsizing the connector 10.

Furthermore, according to the present invention, the connection portion 50 is fixed to the head portion 3 via the plurality of the fixing portions 4 prior to forming the bus bar 5 and the head portion 3 of the bolt 1 together with the housing 9 by insert molding. Consequently, the bus bars 5 and the bolts 1 can be positioned at the predetermined positions within the die used to produce the housing 9 easily by only positioning the bus bars 5, facilitating the preparation of the die for insert molding.

Furthermore, when the nut 13 is threadably mounted to the shank portion 2 of the bolt 1, a torque centered at the shank portion 2 will be applied to the bolt 1. However, according to the present invention, since the circumferential surface 3*b* of the head portion 3 buried in the body portion 7 is knurled, a friction force between the circumferential surface 3*b* of the head portion 3 and the body portion 7 increases. Therefore, the torque applied to the bolt 1 can be prevented from transmitting to the bus bar 5. Also, the bolt 1 can be prevented from idling or being separated from the body portion 7.

Furthermore, although in the above-described embodiment the half portion of the connection portion 50 in the thickness direction is buried in the body portion 7, the whole portion of the connection portion 50, i.e. the whole portion of the metal plate, can be arranged at outside of the body portion 7.

Furthermore, in the above-described embodiment, although the head portion 3 of the bolt 1 is formed into a disk-like shape and the circumferential surface 3*b* of the head portion 3 is knurled, the shape of the head portion of the bolt may be other than the disk-like shape such as a polygonal shape like hexagon. In this case, the circumferential surface of such head portion does not need to be knurled but can still exhibit the effect similar to the above-described head portion 3. In other words, by forming the head portion of the bolt into the polygonal shape, the friction force between the circumferential surface of such head portion and the synthetic resin member can increase, preventing the torque applied to the bolt from transmitting to the metal plate when threadably mounting the nut to the shank portion. Furthermore, by providing a groove to the circumferential surface of the head portion in the circumferential direction, the bolt can be prevented from idling or being separated from the body portion.

Furthermore, "a fixing structure for fixing a metal plate and a bolt to a synthetic resin" according to the present invention can be applied not only to the above-described connector 10 but to any electric components such as a fuse, a buttery or an electric junction box mounted to a motor vehicle.

It is intended that the above-described embodiment is only a representative embodiment, and it should be understood that the present invention is not limited thereto. Various changes and modifications can be made without departing the scope of the present invention.

The invention claimed is:

1. A fixing structure for fixing a metal plate and a bolt to a synthetic resin member, the bolt including a head portion and a shank portion passing through a through hole of the metal plate, the fixing structure comprising:

a fixing portion provided at a surface of the head portion of the bolt, the surface being adjacent to the shank portion of the bolt, wherein the fixing portion is formed to project from the surface of the head portion of the bolt so as to penetrate into the metal plate to be fixed to the metal plate, and wherein the head portion of the bolt is formed integrally with the synthetic resin member by insert molding.

2. A fixing structure for fixing a metal plate and a bolt to a synthetic resin member according to claim 1, wherein the fixing portion is formed into a rib extending from an outer edge of the head portion towards a center of the head portion, and wherein more than one fixing portions are provided with a space between each other.

3. A fixing structure for fixing a metal plate and a bolt to a synthetic resin member according to claim 1, wherein a circumferential surface of the head portion of the bolt is knurled.

4. A connector comprising:

a metal plate to be electrically connected to a wiring member;

a bolt fixing the wiring member and the metal plate together; and a synthetic resin member to which the metal plate and the bolt are mounted, wherein the metal plate and the bolt are fixed to the synthetic resin member by the fixing structure according to claim 1.

5. A fixing structure for fixing a metal plate and a bolt to a synthetic resin member according to claim 2, wherein a circumferential surface of the head portion of the bolt is knurled.

6. A connector comprising:

a metal plate to be electrically connected to a wiring member;

a bolt fixing the wiring member and the metal plate together; and a synthetic resin member to which the metal plate and the bolt are mounted, wherein the metal plate and the bolt are fixed to the synthetic resin member by the fixing structure according to claim 2.

7. A connector comprising:

a metal plate to be electrically connected to a wiring member;

a bolt fixing the wiring member and the metal plate together; and a synthetic resin member to which the metal plate and the bolt are mounted, wherein the metal plate and the bolt are fixed to the synthetic resin member by the fixing structure according to claim 3.

8. A connector comprising:

a metal plate to be electrically connected to a wiring member;

a bolt fixing the wiring member and the metal plate together; and a synthetic resin member to which the metal plate and the bolt are mounted, wherein the metal plate and the bolt are fixed to the synthetic resin member by the fixing structure according to claim 5.

* * * * *